US005938503A

United States Patent [19]

Cook et al.

[11] Patent Number: 5,938,503

[45] Date of Patent: Aug. 17, 1999

[54] ACTIVE CENTERING APPARATUS WITH IMBEDDED SHEAR LOAD SENSOR AND ACTUATOR

[75] Inventors: Gordon Douglas Cook, Sandy; Richard Andrew Daley, Salt Lake City, both of Utah

[73] Assignee: Edo Western Corporation, Salt Lake City, Utah

[21] Appl. No.: 08/977,791

[22] Filed: Nov. 25, 1997

[51] Int. Cl.[6] ..... B24B 49/00

[52] U.S. Cl. ..... 451/10; 451/397; 451/398; 451/5

[58] Field of Search ..... 451/10, 9, 5, 397, 451/398, 243

[56] References Cited

U.S. PATENT DOCUMENTS

| | | | |
|---|---|---|---|
| 3,704,641 | 12/1972 | Rhoades | 82/14 R |
| 3,728,826 | 4/1973 | Wada et al. . | |
| 4,254,676 | 3/1981 | Wilson | 82/34 R |
| 4,516,212 | 5/1985 | Nagashima . | |
| 4,516,750 | 5/1985 | Centner et al. . | |
| 4,570,387 | 2/1986 | Unno et al. . | |
| 4,570,389 | 2/1986 | Leitch et al. . | |
| 4,590,573 | 5/1986 | Hahn . | |
| 4,602,459 | 7/1986 | Drits et al. . | |
| 4,640,057 | 2/1987 | Saljé . | |
| 4,648,025 | 3/1987 | Yoneda et al. . | |
| 4,662,122 | 5/1987 | Ohmura et al. . | |
| 4,709,505 | 12/1987 | Yoneda et al. | 51/165.71 |
| 4,712,332 | 12/1987 | Smith . | |
| 4,766,700 | 8/1988 | Kramberg et al. . | |
| 4,870,786 | 10/1989 | Millay et al. . | |
| 4,897,964 | 2/1990 | Vetter . | |
| 4,926,603 | 5/1990 | Frost et al. . | |
| 4,942,611 | 7/1990 | Kunugi et al. . | |
| 4,953,522 | 9/1990 | Vetter . | |
| 5,018,071 | 5/1991 | Kihara et al. . | |
| 5,054,244 | 10/1991 | Takamatsu et al. . | |
| 5,086,590 | 2/1992 | Athanasiou . | |
| 5,125,188 | 6/1992 | Ogawa et al. . | |
| 5,237,779 | 8/1993 | Ota . | |
| 5,480,342 | 1/1996 | Bannayan et al. . | |
| 5,558,557 | 9/1996 | Dasevsky . | |
| 5,562,523 | 10/1996 | Asano et al. . | |
| 5,562,525 | 10/1996 | Mori et al. . | |
| 5,584,744 | 12/1996 | Shirai et al. . | |
| 5,643,051 | 7/1997 | Zhou et al. . | |
| 5,759,085 | 6/1998 | Gugenheimer et al. | 451/8 |

*Primary Examiner*—David A. Scherbel
*Assistant Examiner*—Dung Van Nguyen
*Attorney, Agent, or Firm*—Thorpe North & Western, LLP

[57] ABSTRACT

An apparatus for sensing and correcting force levels and vibrational frequencies in a cylindrical grinding machine which has active centers. The active centers have imbedded shear load sensors and imbedded actuators. The sensors provide real time grinding information and allow for a determination of undesirable force levels and vibrational frequencies. The actuators are a pair of piezoelectric stacks disposed on opposing sides of the center body in indentations. A voltage applied by a controller causes the piezoelectric stacks to expand and contract. The action of the piezoelectric stacks causes the tip of the center to laterally displace and apply a lateral force to the workpiece. An AC voltage waveform may be applied for force control. A DC voltage may be applied for displacement; for example, to rapidly remove the workpiece from the grinding wheel or to correct for misalignment between the workpiece and the wheel. Because the sensors and actuators are imbedded, they do not interfere with the work space or machine components. In addition, the sensors and actuators are formed in standard sized centers so that the active centers may easily retrofit existing machines.

29 Claims, 7 Drawing Sheets

ACTIVE CENTERING APPARATUS WITH IMBEDDED SHEAR LOAD SENSOR AND ACTUATOR

BACKGROUND OF THE INVENTION

1. Field of the Invention

The present invention relates to an active centering apparatus, particularly suitable for use in cylindrical grinding machines and the like, for sensing force levels and vibrational frequencies and for providing force and displacement compensation. More particularly, the present invention relates to an active centering apparatus having an imbedded shear load sensor and an imbedded actuator.

2. Prior Art

Machining operations, such as cylindrical grinding, generate undesirable force levels and vibrational frequencies between the workpiece and the machine tool. These force levels and vibrational frequencies have a detrimental effect on surface finishes, precision tolerances, and cycle times. For example, a harmonic disturbance force causes a periodic motion between a grinding wheel and the workpiece. The periodic motion causes the workpiece to develop a wavy shape. The periodic motion may be caused by grinding wheel imbalance, bearing vibration, motor vibration, etc.

Older machines, still in use today, operate slowly and are difficult to adjust. For example, retracting the grinding wheel after finishing is slow due to the mass of the grinding wheel and spindle assembly and the use of conventional hydraulic pistons. The slow retraction decreases the quality of the surface finish and increases cycle times. As another example, a misalignment often exists between the workpiece and the grinding wheel, resulting in a taper in the finished workpiece. Correcting for machine misalignment is a time consuming labor intensive technique.

In addition, set-up and calibration time between similar and different workpieces is also time consuming and labor intensive. Furthermore, many machines do not include any type of operator feed-back.

Some devices have been proposed that have a sensor to measure an applied tool force or workpiece displacement and an actuator to control relative movement between the workpiece and the machine or tool. For example, U.S. Pat. No. 5,054,244, issued Oct. 8, 1991 to Takamatsu et al. discloses a polishing apparatus with a rotating polishing tool applied to a workpiece held by a movable table. A load cell or strain gauge is disposed under the table for detecting an applied tool force. The load cell generates a signal which is sent to a controller. The controller generates a signal which is sent to a piezoelectric member, also disposed under the table, which moves the table in response to the workpiece.

Similarly, U.S. Pat. No. 4,590,573, issued May 20, 1986 to Hahn discloses a grinding machine with a workpiece rotatably mounted to a workhead, which in turn is mounted on a base, and an abrasive tool rotatably mounted to a wheelhead. The wheelhead is mounted to a table, which in turn is movably mounted on the base. A feed means moves the tool and wheelhead on the base with respect to the workpiece and workhead. A sensor is disposed on the wheelhead for sensing grinding force. The sensor generates a signal which is sent to a controller. The controller, in turn, generates a signal which is sent to the feed means to move the table, and thus the wheelhead and tool.

Similarly, U.S. Pat. No. 4,602,459, issued Jul. 29, 1986 to Drits et al. discloses a hinged table holding a workpiece against a grinding wheel. A sensor is disposed under the table for sensing the position of the table. The sensor generates a signal which is sent to a controller. The controller generates a signal which is sent to a piezoelectric actuator to pivot the table, and thus the workpiece, with respect to the grinding wheel.

Some of the above devices, however, require special tables to transmit the force or displacement applied by the tool to a sensor and to transmit the force and displacement applied by the actuation to the workpiece. All the above devices respond by activating an actuator to move a table and cause relative movement between the workpiece and a tool. None of the above devices address cylindrical grinding machines or similar machines that support the workpiece between spindles or centers.

In addition, many older machines are still in use today and do not include any type of force sensors or controls. These older machines comprise many different models from different manufactures. Thus, numerous different retro-fit designs would be required to provide for customized tables to fit the different physical configurations. In addition, retro-fitting older machines would require a great deal of machine down-time. Therefore, custom modifications for existing machines seems impractical.

Therefore, it would be advantageous to develop a device capable of sensing and/or responding to undesirable force levels and vibrational frequencies. It also would be advantageous to develop such a device capable of being used with existing machines without extensive retro-fitting. It also would be advantageous to develop such a device for providing real-time force measurement without disturbing the work space in order to determine undesirable force levels and frequencies. It also would be advantageous to develop such a device capable of adjusting for relative taper between the workpiece and the tool. In addition, it would be advantageous to develop such a device capable of rapidly removing the workpiece from the tool.

OBJECTS AND SUMMARY OF THE INVENTION

It is an object of the present invention to provide a device for sensing and/or compensating for undesirable forces between a workpiece and a tool, such as a cylindrical grinding machine.

It is another object of the present invention to provide such a device for use on existing machines without extensive retro-fitting.

It is yet another object of the present invention to provide a device for providing real time measurement of force levels and vibrational frequencies in order to determine what force levels and vibrational frequencies may be undesirable, and compensate for them accordingly.

It is yet another object of the present invention to provide a device for eliminating the misalignment between the workpiece and the tool.

It is a further object of the present invention to provide a device for rapidly removing the workpiece from the tool to improve surface finish and cycle times.

These and other objects and advantages of the present invention are realized in an active center device having an imbedded shear load sensor and an imbedded piezoelectric actuator. The shear load sensor senses force levels and vibrational frequencies generated between the workpiece and the grinding wheel. The sensor develops a sensor signal and supplies the signal to a controller.

The piezoelectric actuator includes a pair of piezoelectric stacks disposed on opposing sides of the center body. The stacks are disposed in a pair of indentations also formed in opposing sides of the center body. A web is formed between the pair of indentations. The piezoelectric stacks are responsive to control signals developed and supplied by the controller. The signals cause the stacks to expand and contract. Because the piezoelectric stacks are contained in the indentations, their expansion and contraction causes the center body to bend. Because the center is fixed in a stock, the tip of the center bends about the web. Thus, the actuators cause the tip to displace laterally and apply a lateral force to the workpiece.

The controller monitors the characteristics of the cylindrical grinding machine and compensates for changes. Thus, the controller can calibrate the grinding machine set-up and adjust performance. The result is better surface finishes and faster through-put.

The controller may supply an AC voltage waveform to the actuators to provide force control. The controller may also supply a DC voltage to cause a known displacement of the tip. Thus, the workpiece may be rapidly removed from the grinding wheel for better surface finish and faster through-put. In addition, the workpiece may be adjusted with respect to the grinding wheel to correct for misalignment. Furthermore, the workpiece may be adjusted radially, during the grinding operation, to produce a contoured pattern along the circumferential surface of the workpiece.

These and other objects, features, advantages and alternative aspects of the present invention will become apparent to those skilled in the art from a consideration of the following detailed description taken in combination with the accompanying drawings.

DETAILED DESCRIPTION OF THE INVENTION

Reference will now be made to the drawings in which the various elements of the present invention will be given numerical designations and in which the invention will be discussed so as to enable one skilled in the art to make and use the invention.

Figure 1:
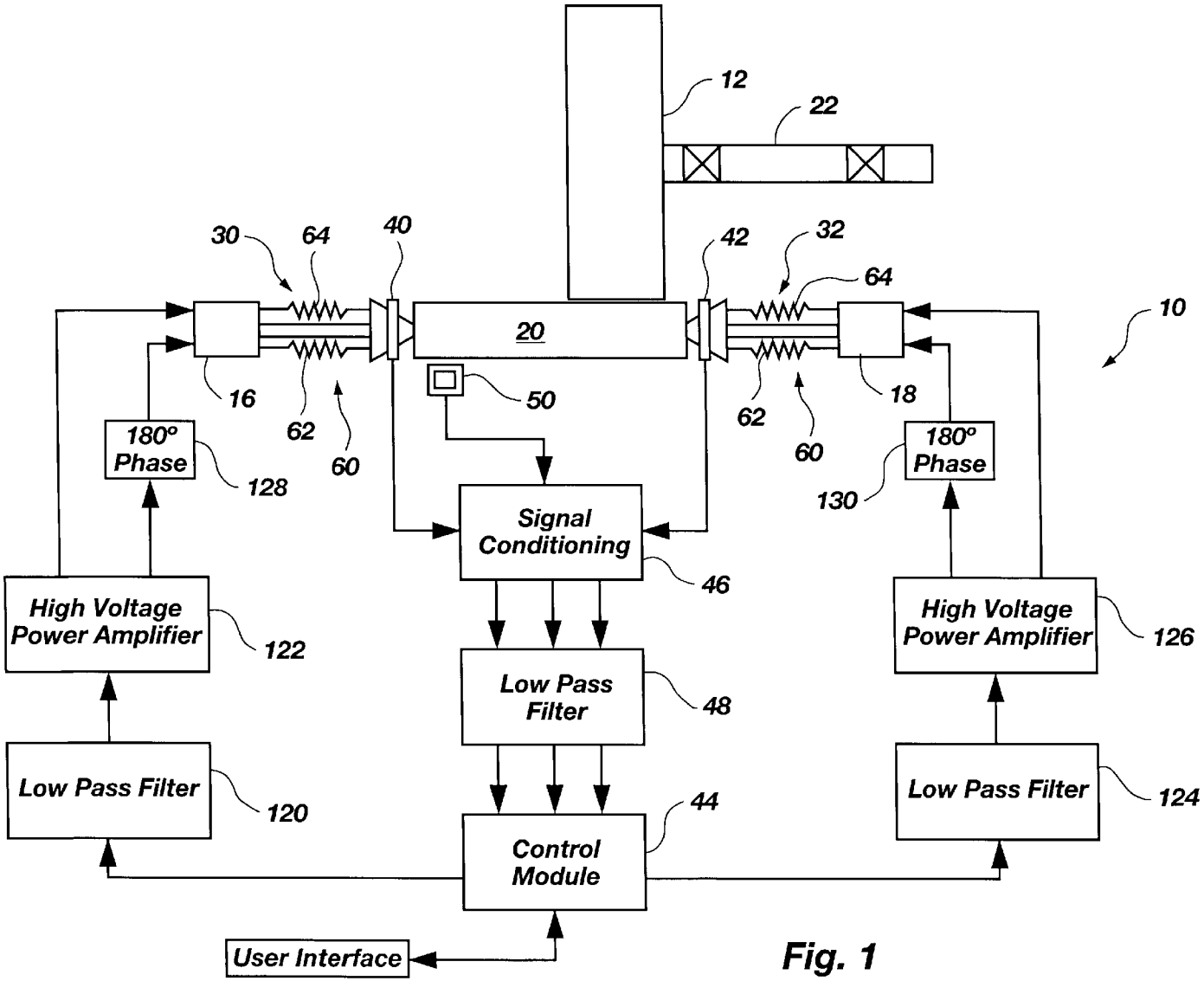
FIG. 1 is a schematic view of a preferred embodiment of an apparatus for use with cylindrical grinding having active centers in accordance with the principles of the present invention.
Figure 2:
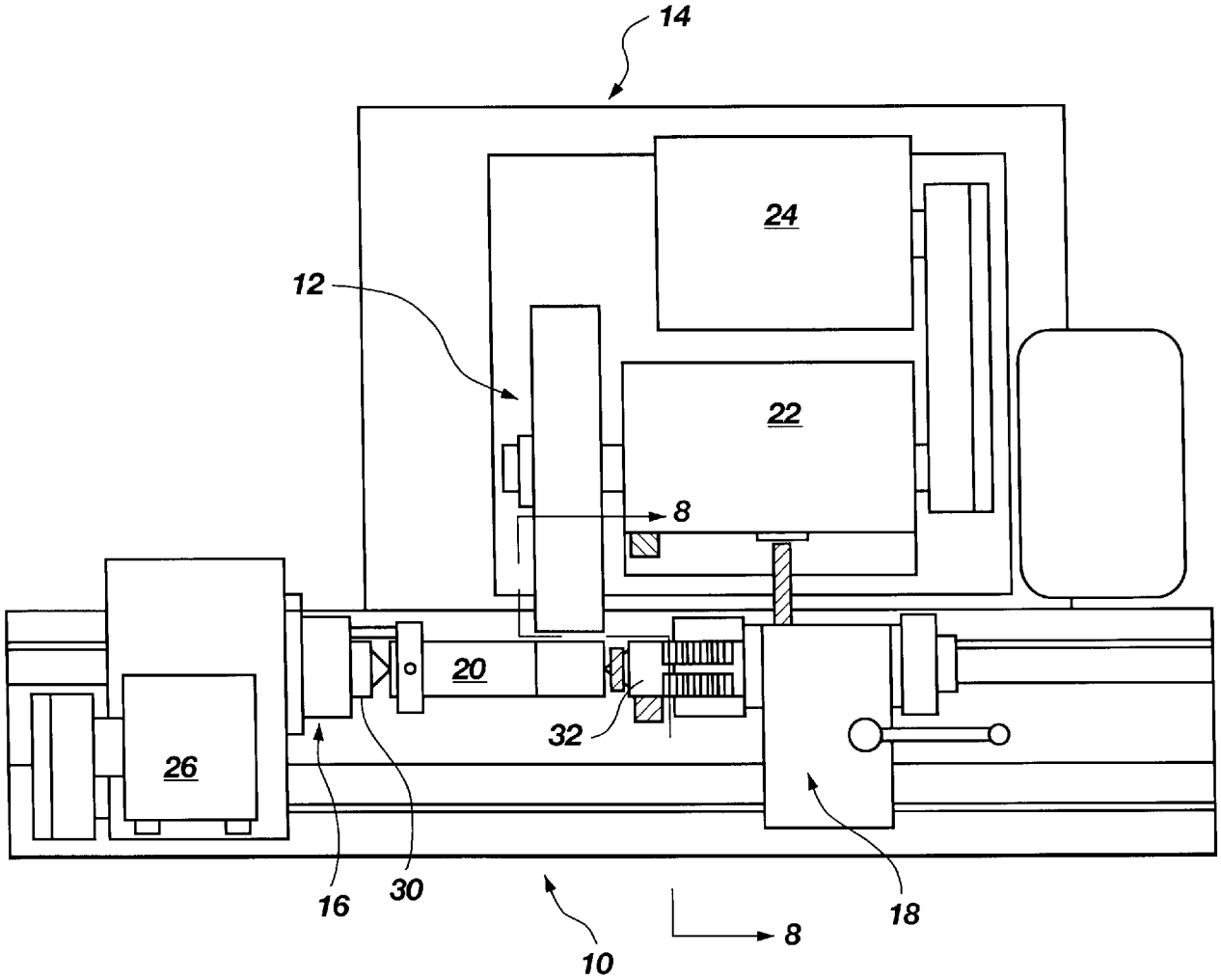
FIG. 2 is a top view of a preferred embodiment of the active centers of the present invention installed on a cylindrical grinding machine.

As illustrated in FIG. 1, an active center apparatus for sensing and compensating for undesirable forces, indicated generally at 10 of the present invention, is shown with a material removing tool, in this case a grinding wheel 12. Similarly, as illustrated in FIG. 2, a portion of the apparatus, again indicated at 10, is shown with a material removing machine, in this case a cylindrical grinding machine 14. Referring now to FIGS. 1 and 2, the cylindrical grinding machine has a headstock 16 and a tailstock or footstock 18, between which a workpiece 20 is disposed for receiving a surface treatment by the grinding wheel 12. In typical, prior art grinding machines, the workpiece 20 is actually held between a headstock center and a tailstock center, each disposed in bores formed in the headstock and tailstock, respectively. The conventional centers are elongated cylindrical/conical bodies with a tip for supporting the workpiece. The shape and size of the center bodies are standard. Because these conventional centers are little more than a pointed steel rod, they are referred to as "dead" centers.

Referring to FIG. 2, the grinding wheel 12 is rotatably mounted to a spindle 22, which in turn is connected to a motor 24. The grinding wheel 12 and spindle 22 form an assembly which is moved with respect to the workpiece 20 by hydraulic cylinders (not shown) to apply a grinding force to the workpiece and to accommodate workpieces of various diameters. The headstock 16 rotates with the workpiece 20 and is connected to a motor 26. The tailstock 18 is adjustably positioned with respect to the head stock 16 to accommodate workpieces of various lengths. The grinding wheel 12 typically rotates at high speed, around 1500 rpm, with respect to the workpiece. Thus, the abrasive surface of the grinding wheel 12 removes material from the surface of the workpiece 20 to produce a desired surface finish. The headstock 16 rotates the workpiece 20 at low speed, around 240 rpm, with respect to the grinding wheel to expose the entire circumference of the workpiece to the grinding wheel.

Referring again to FIG. 1, the apparatus 10 of the present invention includes a pair of active centers, a headstock center 30 and a tailstock center 32. The active centers 30 and 32 advantageously have the same standard shape and standard size of the conventional centers. Thus, the centers 30 and 32 may be received within the standard headstock 16 and tailstock 18 of conventional cylindrical grinding machines. Therefore, the centers of the present invention may be easily and quickly installed on existing machines in order to retro-fit the machines for the force sensing and compensating apparatus. There is no need to custom design fixtures or other elements to accommodate movement of different wheel/spindle assemblies or headstock and tailstock assemblies. In addition, the centers of the present invention fit within existing machines without interfering with the work space or machine components.

Figure 3:
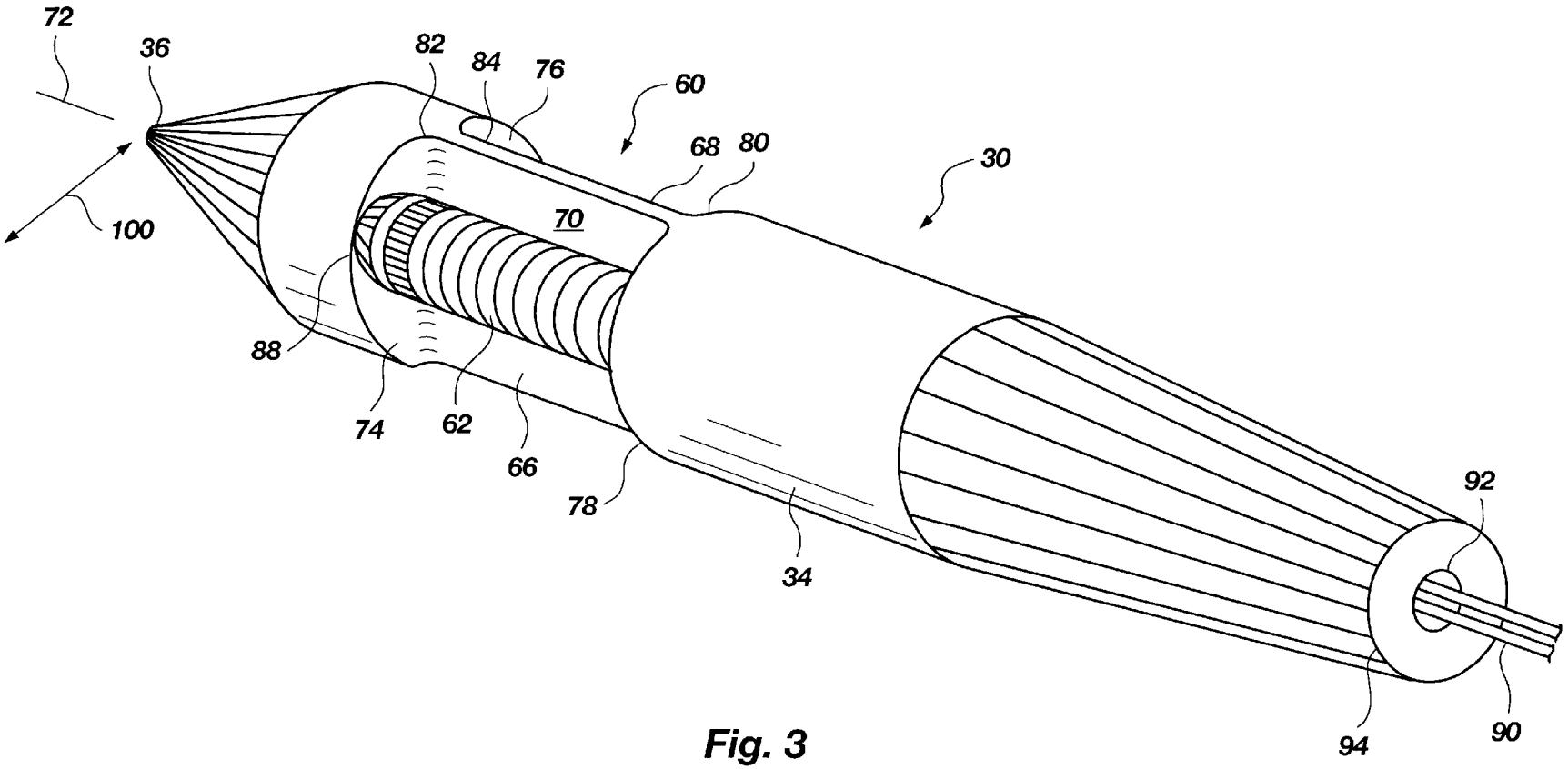
FIG. 3 is a perspective view of a preferred embodiment of the active center of the present invention with a piezoelectric stack exposed.
Figure 4:
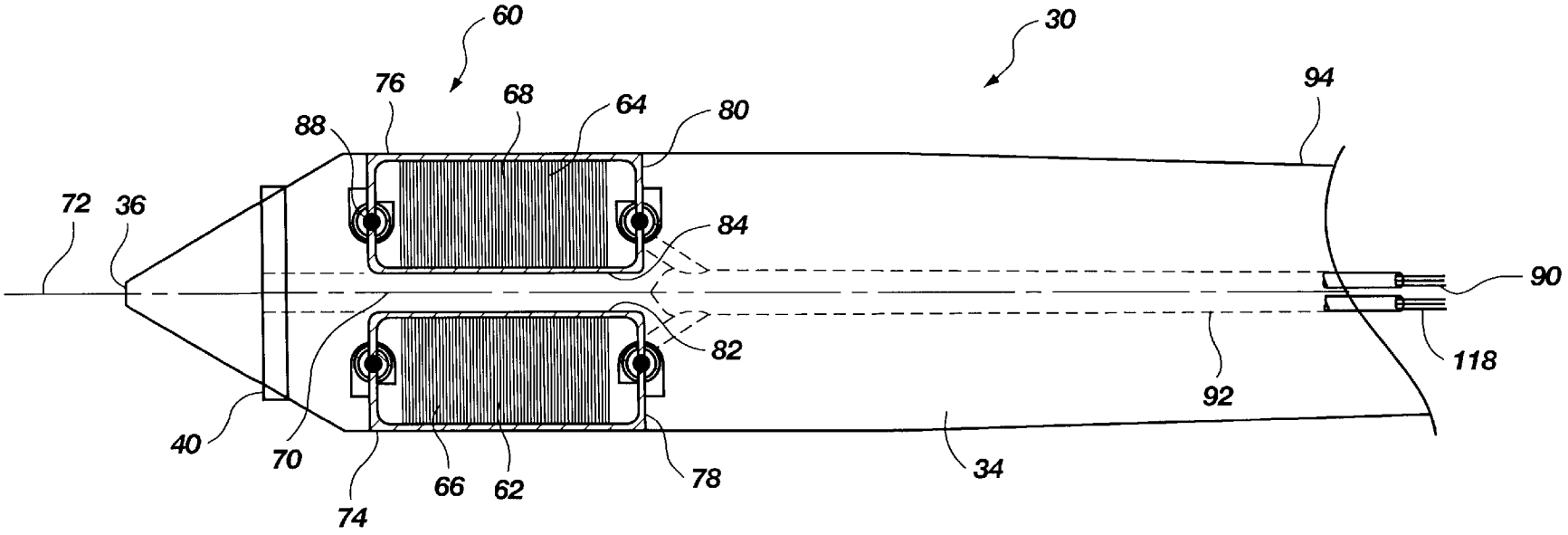
FIG. 4 is a top view of a preferred embodiment of an active center of the present invention.
Figure 9:
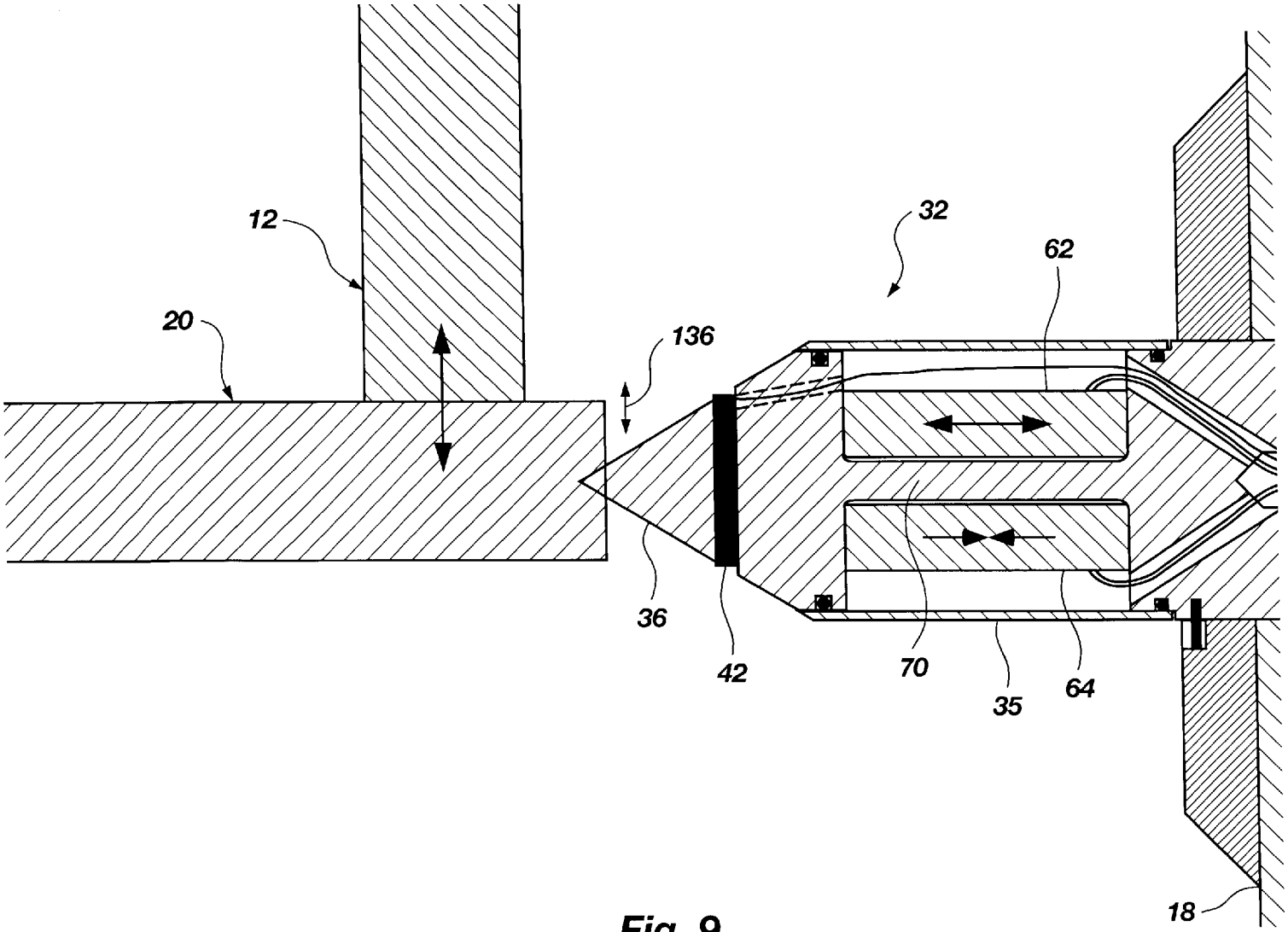
FIG. 9 is a cross sectional view of a preferred embodiment of an active center installed on a cylindrical grinding machine taken along line 9—9 of FIG. 2.

Referring to FIGS. 3 and 4, each center, indicated at 30, has a similar construction including an elongated cylindrical/conical body 34, which has a standard shape and size to fit in conventional headstocks and tailstocks. As shown in the figures, a cylindrical cover 35, as shown in FIG. 9, has been removed from the body to expose the internal components of the center. The body 34 has a pointed, conical tip 36 for inserting in an indentation on the end of the workpiece to support the workpiece.

Referring again to FIGS. 1 and 4, each center 30 and 32 advantageously has an embedded shear load sensor 40 and 42 respectively, disposed generally near the tip 36 of the body 34. The shear load sensor 40 is a well known device that is selected to be as small and thin as possible so as not to interfere with the operation of the centers. The sensor 40 fits generally within the conical envelope of the tip 36. The sensor 40 is a structural element mounted between the tip 36 and the body 34. Forces generated between the workpiece and the grinding wheel or other cutting tool are transferred to the tip 36, through the sensor 40 where they are sensed and transformed in to proportional electrical signals, and into the body 34 of the center 30. The shear load sensor is relatively stiff with respect to the surrounding mechanisms so that its presence does not significantly influence the forces it is measuring, or change the overall deflections of the system. Because the shear load sensors 40 and 42 are imbedded in the centers 30 and 32, they do not interfere with the work space and do not require custom fixtures, such as tables.

The shear load sensors 40 and 42 advantageously sense force levels and vibrational frequencies developed between the grinding wheel 12 and the workpiece 20. The sensors 40 and 42 develop signals which are received by a control module 44. The signals may pass through signal conditioning 46 and a low pass filter 48 before being received by the control module 44. Using the signals developed by the sensors 40 and 42, a determination may be made as to which force levels and vibrational frequencies are undesirable. Undesirable forces and vibrational frequencies are those which deviate from the most efficient conditions. The precise nature of the most efficient conditions may vary with tool type, worpiece material, and other conditions specific to each situation. The most efficient conditions may be the subject of theoretical analysis, or may be arrived at by purely trial-and-error methods. Typically, however, there is a smooth, rapid increase in workpiece-to-tool forces that is appropriate to efficient cutting, followed by a gradual reduction in forces as material is removed and the cutting is completed. Undesirable forces are those which occur too rapidly for efficient cutting, or decay more slowly than is most efficient for rapid throughput, or have higher frequency components that leave undesired waviness or "chatter marks" in the finished workpiece. Using the information gathered by the sensors, the grinding machine may be set-up and calibrated to improve surface finishes and cycle times.

A tachometer 50, or other revolution measuring device, may be disposed adjacent the workpiece 20 to measure the rotational rate of the workpiece. The tachometer develops a reference signal which is received by the controller 44. Because the surface contour of the workpiece repetitively contacts the cutting tool with each revolution, control algorithms may use this information gathered from the tachometer for synchronization. Referring again to FIGS. 3 and 4, the centers, indicated at 30, advantageously have an imbedded actuator, indicated at 60, to compensate for force and displacement between the workpiece 20 and the grinding wheel 12 (FIGS. 1 and 2). The actuator 60 is preferably a pair of piezoelectric stacks 62 and 64 disposed on opposing sides of the body. A pair of notches 66 and 68 are formed on opposing sides of the center body 34 for receiving the stacks 62 and 64. A generally planar web 70 is formed between the notches 66 and 68 and is collinear with a longitudinal axis 72 of the body 34. Each notch 66 and 68 has a forward wall 74 and 76, a rearward wall 78 and 80, and an inner wall 82 and 84. The portion of the body 34 between the inner walls 82 and 84 of the notches 66 and 68 form the web 70.

The piezoelectric stacks 62 and 64 are disposed in the notches 66 and 68, respectively. The piezoelectric stacks 62 and 64 extend between the forward walls 74 and 76 and the rearward walls 78 and 80 of the notches 66 and 68, respectively. Contact bearings 88, typically cylindrical, may be disposed between the piezoelectric stacks 62 and 64 and the forward and rearward walls 74, 76, 78, and 80. Wires 90 are electrically connected to the piezoelectric stacks 62 and 64 and extend from the stacks, through a bore 92, and out an end 94 of the body 34.

Figure 5:
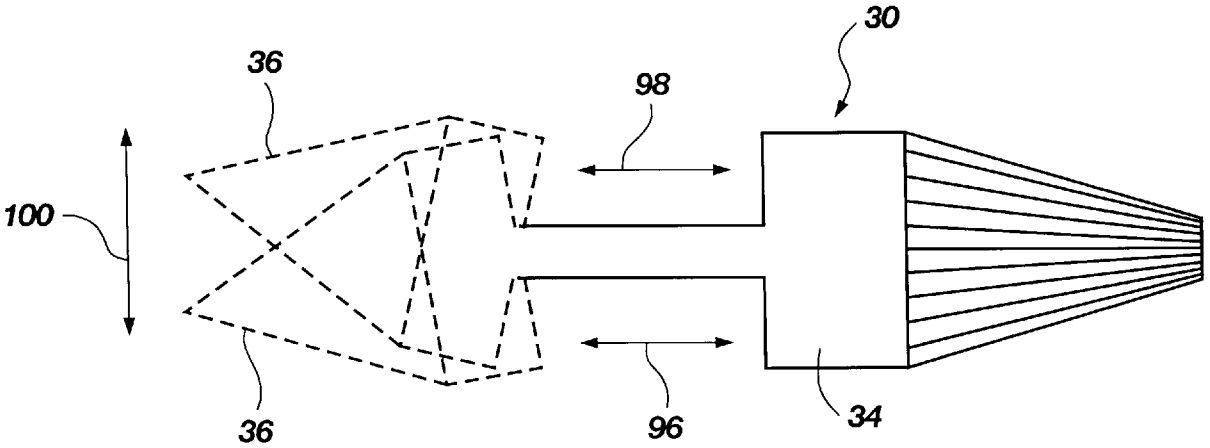
FIG. 5 is a top view of a preferred embodiment of the active center with the movement of the tip shown in dashed lines.

An electrical signal is applied to the piezoelectric stacks 62 and 64 causing them to expand and contract. As the piezoelectric elements 62 and 64 expand they exert a linear force, illustrated by arrows 96 and 98 (FIG. 5), between the forward walls 74 and 76 and rearward walls 78 and 80, respectively. The force exerted by the piezoelectric stacks is generally parallel to the longitudinal axis 72 of the center. The stacks 62 and 64, however, are disposed on opposing sides of the center body 34, off-set from the longitudinal axis 72. Thus, as the stacks 62 and 64 expand and contract, they cause the body 34 to bend about the web 70. Because the centers 30 and 32 (FIG. 1) are disposed in the headstock 16 and the tailstock 18 respectively (FIG. 1), they are fixed. Thus, the tip 36 of the center 30 bends about the web 70 and displaces laterally, as illustrated by arrow 100 in FIG. 5. Therefore, the piezoelectric stacks 62 and 64 cause the tip 36 to laterally displace 100 and exert a lateral force on the workpiece, and thus the grinding wheel.

Figure 7:
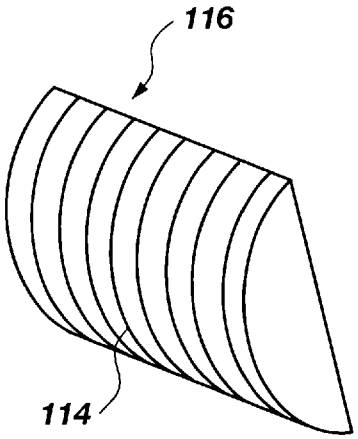
FIG. 7 is a perspective view of an alternative embodiment of a piezoelectric stack of the present invention.
Figure 6:
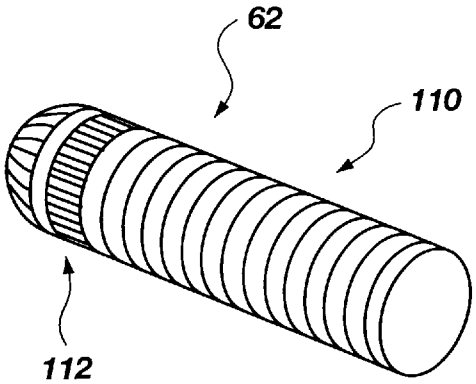
FIG. 6 is a perspective view of a preferred embodiment of a piezoelectric stack of the present invention.

As illustrated in FIG. 6, the piezoelectric stacks, represented by 62, include a plurality of piezoelectric elements or actuator layers 110. Each piezoelectric layer 110 responds to the electrical signal supplied through the wires 90 (FIGS. 3 and 4). Each piezoelectric element or layer 110 is generally circular, causing the piezoelectric stack 62 to be generally cylindrical. Alternatively, each layer 114 may be generally semi-circular, causing the stack 116 to be semi-cylindrical, as shown in FIG. 7.

In addition, the stack 62 may include a piezoelectric sensor or sensor layer 112. The sensor layer 112 develops a signal which is sent through a wire 118 to the controller as shown in FIG. 4. The forces can be monitored by monitoring the voltage generated by the sensor layer.

Although the active centers 30 and 32 have been described with reference to piezoelectric actuators, it is of course understood that the actuators may be any type of actuator, such as hydraulic, pneumatic, solenoid, magnetrostriction, etc.

Figure 8:
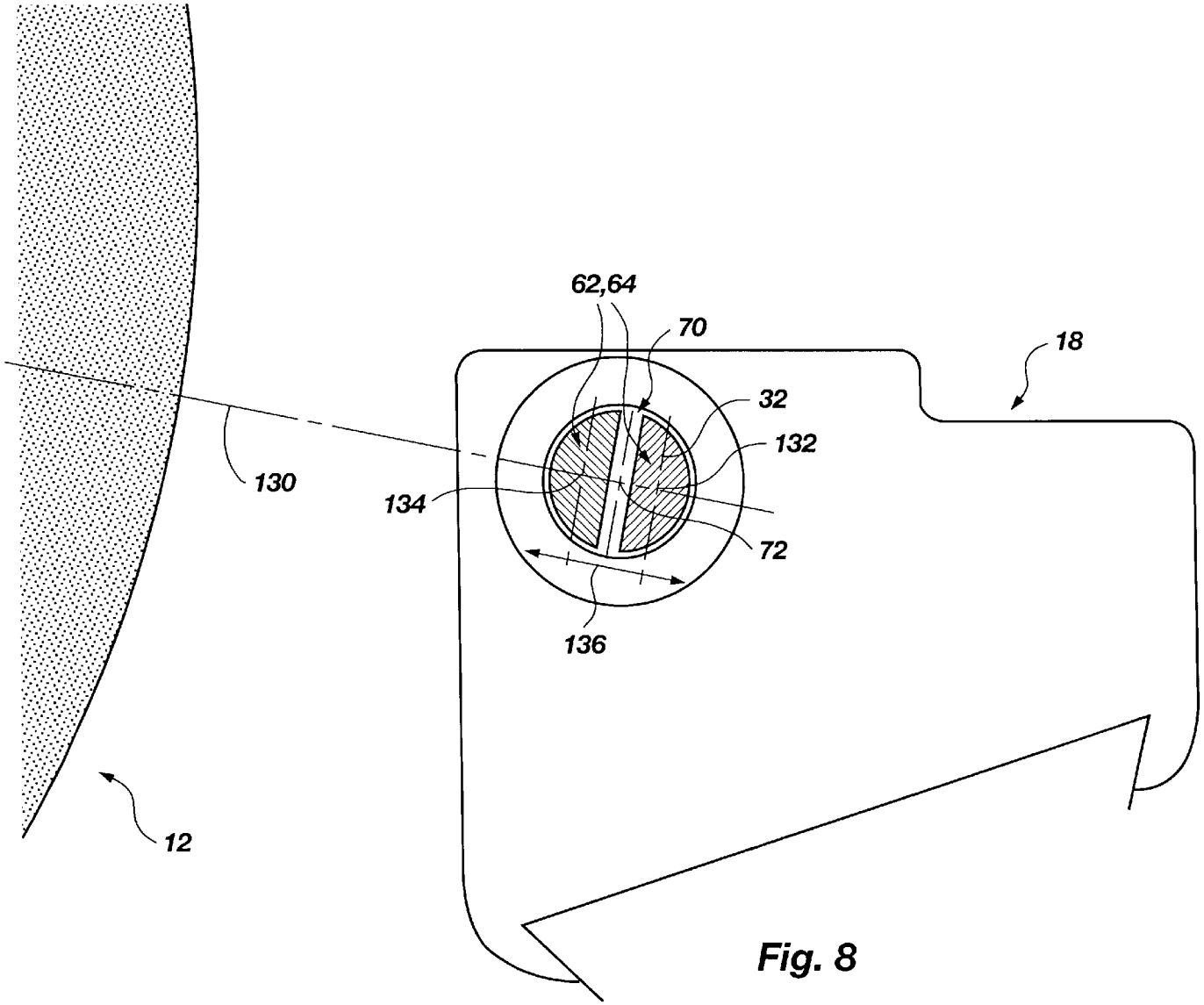
FIG. 8 is a cross sectional view of a preferred embodiment of an active center installed on a cylindrical grinding machine taken along line 8—8 of FIG. 2.

As illustrated in FIGS. 8 and 9, the tailstock center 32 is shown disposed in the tailstock 18. The longitudinal axis 72 of the center 32, and of the workpiece 20, and an axis (not shown) of the grinding wheel 12 form a line of centers 130, or a line passing through both axes, as shown in FIG. 8. The tailstock center 32 is oriented such that the web 70 is generally perpendicular to the line of centers 130, as shown in FIG. 8. In other words, axis 132 and 134 of the piezoelectric stacks 62 and 64 respectively, lay in the plane of the line of centers 130. Thus, the actuators 62 and 64 cause the tip 36 (FIG. 9), and thus the workpiece 20, to move toward or away from the grinding wheel 12, as shown by arrow 136. In addition, the actuators cause the center to apply a force toward or away from the grinding wheel, again as shown by arrow 136. The headstock center 30 is similarly oriented.

Referring again to FIG. 1, the actuator 60 of the headstock center 30 and the actuator 60 of the tailstock center 32 are responsive to first and second control signals, respectively. The control signals are developed by and supplied to the actuators 60 by the controller 44. The first control signal may pass through a low pass filter 120 and a high voltage power amplifier 122 and the second control signal may similarly pass through a low pass filter 124 and a high voltage power amplifier 126.

The controller 44 monitors the cylindrical grinding machine characteristics and compensates for changes in the speed of the workpiece 20 or the grinding wheel 12, grinding wheels of different diameters, and workpieces with different diameters and masses. In addition, any other conditions that deviate from the ideal conditions may be compensated for. The controller provides for calibrating the grinding machine set-up and for adjusting performance characteristics. Through the active centers, the controller actively controls the grinding process for better surface finishes and lower cycle times.

The signal waveform sent to one piezoelectric stack 62 may be phase inverted or 180 degrees phase shifted from the other stack 64, as represented at 128 and 130. Thus, one stack 62 expands while the other 64 contracts to displace the tip 36 (not shown) and apply a lateral force. The control signal waveform developed by the controller 44 may be, or may be converted to, an AC voltage waveform. An AC voltage waveform is preferable for active force control. Alternatively, the control signal may be, or may be converted to, a DC voltage. A DC voltage may be applied to the actuator, or piezoelectric stacks, to cause a known displacement of the tips 36, and thus the workpiece 20 toward or away from the grinding wheel 12.

A DC voltage advantageously may be applied to both centers 30 and 32 to cause the workpiece to be rapidly removed from the grinding wheel. Thus, after finishing, the workpiece may be rapidly withdrawn from the grinding wheel, as opposed to slowly moving the grinding wheel/spindle assembly away as conventionally done. Rapidly removing the workpiece results in a better surface finish and lower cycle time, and thus higher through-put.

In addition, a DC voltage advantageously may be applied to one of the centers to move one end of the workpiece towards or away from the grinding wheel. Thus, any misalignment between the workpiece and the grinding wheel may be corrected by laterally displacing the tip of the center, as opposed to manually correcting for machine misalignment as conventionally done. Adjusting the misalignment by laterally displacing the tip of the center results in lower cycle time and thus higher through-put.

Thus far, the active centering apparatus of the present invention has been described with respect to compensating for undesirable conditions including undesirable force levels and vibrational frequencies. In addition, the apparatus of the present invention may be used to impart a contoured shape into the workpiece. Such a contoured surface may be impossible, or at least very difficult, to achieve by traditional means. The contoured surface may be used as longitudinal bearing raceways or to create keyed fits of parts into similarly contoured holes. Such contoured surfaces may be shaped as multi-pointed star patterns or rectangles when viewed in cross-section.

Because the centers of the present invention have imbedded sensors for sensing force levels and vibrational frequencies and because they have imbedded piezoelectric actuators to compensate for force and displacement, they are referred to as "active" centers, as opposed to the "dead" centers of the prior art. It is of course understood that although the centers of the present invention have been described and illustrated as having both imbedded sensors and imbedded actuators, the centers may have only a sensor or an actuator. In addition, although the present invention has been described and illustrated with respect to centers for cylindrical grinding machines, it is of course understood that other types of machines and other types of workpiece holders may be imbedded with sensors and/or actuators in accordance with the principles of the present invention.

It is to be understood that the described embodiments of the invention are illustrative only, and that modifications thereof may occur to those skilled in the art. Accordingly, this invention is not to be regarded as limited to the embodiments disclosed, but is to be limited only as defined by the appended claims herein.

What is claimed is:

1. An active centering apparatus for rotatably supporting a workpiece in a cylindrical grinding machine having head and tail stocks and monitoring force level and vibrational frequency comprising:

a center body configured for insertion in the head and tail stocks of the machine and having a tip configured for supporting a workpiece; and a shear load sensor disposed in the body and adapted for sensing force levels and vibrational frequencies between the machine and the workpiece to provide real-time information and to determine which force levels and vibrational frequencies may be undesirable.

2. An active centering apparatus for rotatably supporting a workpiece and providing force and displacement compensation comprising:

a center body configured for insertion in a stock of a machine and having a tip configured for supporting a workpiece; and an actuator disposed in the center body and adapted for applying a lateral force and a lateral displacement to the tip, and thus the workpiece, to thereby accurately position the workpiece and minimize unwanted forces between the workpiece and the machine.

3. The apparatus of claim 2, wherein the actuator is responsive to control signals to apply a lateral force and displacement to the tip, and thus the workpiece; and further comprising control means for developing and supplying control signals to the actuator.

4. The apparatus of claim 3, wherein the control signals are an AC voltage waveforms to control the force between the workpiece and the machine.

5. The apparatus of claim 3, wherein the control signals are a DC voltage to create a known displacement of the workpiece in order to eliminate misalignment between the workpiece and the machine.

6. The apparatus of claim 3, wherein the control signals are a DC voltage to create a known rapid displacement of the workpiece in order to rapidly retract the workpiece from the machine.

7. The apparatus of claim 2, wherein the center body comprises a pair of notches formed on opposing sides of a longitudinal axis of the body, the notches configured for receiving the actuator; and a web formed between the pair of opposing notches and collinear with a longitudinal axis of the body, the web bending under the force of the actuator.

8. The apparatus of claim 2, wherein the actuator is a piezoelectric actuator.

9. The apparatus of claim 2, wherein the actuator comprises a pair of piezoelectric stacks disposed on opposing sides of a longitudinal axis of the body to cause the body to bend, thereby laterally displacing the tip.

10. The apparatus of claim 9, wherein the piezoelectric stack has a generally semi-cylindrical shape.

11. The apparatus of claim 2, wherein the actuator comprises a series of piezoelectric layers including at least one actuator layer; and a sensor layer.

12. An active centering apparatus for rotatably supporting a workpiece comprising:

a center body configured for insertion in a stock of a machine and having a tip configured for supporting a workpiece;

a shear load sensor disposed in the body and adapted for sensing forces between the machine and the workpiece; and an actuator disposed in the center for applying a lateral force and a lateral displacement to the tip, and thus the workpiece, to thereby accurately position the workpiece and minimize unwanted forces between the workpiece and the machine or create surface contours in the workpiece.

13. The apparatus of claim 12, wherein the actuator is responsive to control signals to apply a lateral force and displacement to the tip, and thus the workpiece; and further comprising control means for developing and supplying control signals to the actuator.

14. The apparatus of claim 13, wherein the control signals are an AC voltage waveforms to control the force between the workpiece and the machine.

15. The apparatus of claim 13, wherein the control signals are a DC voltage to create a known displacement of the workpiece in order to eliminate misalignment taper between the workpiece and the machine.

16. The apparatus of claim 13, wherein the control signals are a DC voltage to create a known rapid displacement of the workpiece in order to rapidly retract the workpiece from the machine.

17. The apparatus of claim 12, wherein the center body comprises a pair of notches formed on opposing sides of a longitudinal axis of the body, the notches configured for receiving the actuator; and a web formed between the pair of opposing notches and collinear with a longitudinal axis of the body, the web bending under the force of the actuator.

18. The apparatus of claim 12, wherein the actuator is a piezoelectric actuator.

19. The apparatus of claim 12, wherein the actuator comprises a pair of piezoelectric stacks disposed on opposing sides of a longitudinal axis of the body to cause the body to bend, thereby laterally displacing the tip.

20. The apparatus of claim 19, wherein the piezoelectric stack has a generally semi-cylindrical shape.

21. The apparatus of claim 13, wherein the actuator comprises a series of piezoelectric layers including at least one actuator layer; and a sensor layer.

22. An active center apparatus for rotatably holding a workpiece in a cylindrical grinding machine, the apparatus comprising:

a headstock center having a body configured for insertion in a headstock of a cylindrical grinding machine, a tip configured for supporting a workpiece, a shear load sensor disposed in the body and adapted for sensing grinding forces and developing first sensor signals, and an actuator disposed in the center and responsive to first control signals for applying lateral force and displacement to the tip to thereby provide force and displacement compensation;

a tailstock center having a body configured for insertion in a tailstock of the cylindrical grinding machine, a tip configured for supporting the workpiece, a shear load sensor disposed in the body and adapted for sensing grinding forces and developing second sensor signals, and an actuator disposed in the center and responsive to second control signals for applying lateral force and displacement to the tip to thereby provide force and displacement compensation; and a control means for receiving the first and second sensor signals and supplying first control signals to the headstock center, and second control signals to the tailstock center.

23. The apparatus of claim 22, wherein each center body comprises a pair of notches formed on opposing sides of a longitudinal axis of the body, the notches configured for receiving the actuator; and a web formed between the pair of opposing notches and collinear with a longitudinal axis of the body; and wherein the actuators cause the body to bend about the web in order to provide lateral force and displacement to the tip.

24. The apparatus of claim 22, wherein the actuator comprises a pair of piezoelectric stacks disposed on opposing sides of a longitudinal axis of the body; and wherein the piezoelectric stacks cause the body to bend in order to laterally displace the tip.

25. The apparatus of claim 24 wherein the piezoelectric actuator comprises a series of layers including at least one actuator layer; and a sensor layer.

26. The apparatus of claim 24 wherein the piezoelectric stack has a generally semi-cylindrical shape.

27. The apparatus of claim 22, wherein the control signal is an AC voltage waveforms to control the force between the workpiece and the grinding machine.

28. The apparatus of claim 22, wherein the control signal is a DC voltage to create a known displacement of the workpiece in order to eliminate misalignment between the workpiece and a grinding wheel.

29. The apparatus of claim 22, wherein the control signal is a DC voltage to create a known rapid displacement of the workpiece in order to rapidly retract the workpiece from a grinding wheel.

* * * * *